US005655401A

United States Patent [19]

Bauer et al.

[11] Patent Number: 5,655,401

[45] Date of Patent: Aug. 12, 1997

[54] TABBING TOOL AND METHOD

[75] Inventors: Theodore L. Bauer, North Canton; Larry P. Cain, Clinton, both of Ohio

[73] Assignee: InterBold, North Canton, Ohio

[21] Appl. No.: 556,559

[22] Filed: Nov. 13, 1995

[51] Int. Cl.[6] ..... B21D 37/10

[52] U.S. Cl. ..... 72/334; 72/379.2; 72/412

[58] Field of Search ..... 72/379.2, 377, 72/325, 412, 334; 413/67, 55, 17

[56] References Cited

U.S. PATENT DOCUMENTS

| | | | |
|---|---|---|---|
| 3,211,034 | 10/1965 | Andris | 72/334 |
| 3,357,078 | 12/1967 | Moltchan | 72/325 |
| 4,154,184 | 5/1979 | Keller | 413/17 |

FOREIGN PATENT DOCUMENTS

| | | | |
|---|---|---|---|
| 2402686 | 7/1974 | Germany | 413/67 |
| 241408 | 12/1986 | Germany | 72/334 |
| 94938 | 4/1991 | Japan | 413/67 |

*Primary Examiner*—Daniel C. Crane
*Attorney, Agent, or Firm*—Ralph E. Jocke

[57] ABSTRACT

A tabbing tool for reducing residual tab burrs on parts punched from a generally flat sheet metal piece (50) includes a punch portion (10) and a die portion (32). The punch portion includes a first punch face (24) that extends at a shallow angle and a second punch face (26) that extends at a greater angle. The die portion includes a recess (38) bounded by a straight edge (40). The recess is further bounded by a first die surface (42), a generally vertically extending second die surface (44) and a third die surface (46) that extends at the shallow angle. In operation a tab (58) which extends between a part portion (60) and an external portion (62) is deformed between the punch and die portions of the tabbing tool to compress and thin the tab adjacent to the part portion and cause the tab to extend into the recess in the die portion. Upon defining the contour of the part by punching openings in the piece, the part is removed by shaking the piece. Shaking fractures the tab portions and minimal tab burrs remain with the part. Burrs that do remain are readily removed through automatic deburring operations.

36 Claims, 7 Drawing Sheets

TABBING TOOL AND METHOD

TECHNICAL FIELD

This invention relates to metal forming devices and methods. Specifically, this invention relates to a tabbing tool and a method that is used to reduce burrs on parts that are manufactured by selectively punching openings in sheet material so as to define the part contours.

BACKGROUND ART

It is common to manufacture parts from many types from sheet materials. Specifically, the manufacture of sheet metal parts is well known.

One approach to producing sheet metal parts that is known in the prior art is to fabricate metal parts from sheet metal blanks cut from a generally planar piece of metal stock. Blanks are typically cut using punch and die sets which punch the blank from the metal sheet in a single operation. Once the blank is produced it may be further formed through other operations such as drilling, or die or roll forming. The drawback associated with this approach is that the tooling necessary to produce the blank as well as to perform the subsequent operations is specifically made to produce a specific part. This may require a significant outlay for special tooling which adds to the cost of producing the parts.

A more recent alternative to the approach of producing parts from sheet materials using dedicated tooling is the use of programmable high speed multi-punch machines. Such machines use relatively small standardized punch and die shapes to punch a series of holes in a piece of sheet material. The machine punches adjacent holes at high speed so as to define the contours of one or more parts. Such machines enable the punching of parts from a single sheet, in a cookie-cutter fashion, using standardized and inexpensive tooling. An example of programmable high speed multi-punch machines are machines produced by Trumpf, Inc. of Farmington, Conn.

During production of parts on programmable multi-punch machines it is necessary to maintain the metal part being fabricated in place relative to the sheet until all the contours of the part have been defined by the punching of openings. This is accomplished by leaving small fingers of material called "tabs" or "webs" that extend across the openings which separate the area of the sheet that will become the part from the external portion of the sheet that will not become part of a part. The tabs hold the part portion solidly connected to the sheet during punching operations by various tools. This enables the sheet to be moved rapidly and precisely by an automated positioning mechanism to enable the precise punching of openings at the desired locations under the programmable control of the machine.

The tabs are sufficiently wide and strong so as to hold the parts portions in place, but are thin enough to enable the parts to be readily separated from the rest of the sheet. The separation of the parts is accomplished after the punching operations are completed, usually by shaking the sheet. This deforms the sheet. Because the parts portions are connected to the sheet only by the thin tabs, the deformation of the sheet creates stresses in the tabs that causes them to break. As a result, the parts portions fall out of the sheet or other work piece, and are ready for other processing. The external portions of the piece which do not become parts are recycled, as are all of the slugs that are cut out of the sheet during the punching process.

The significant advantage of such high speed fabrication is that punches of various types may be used to define the contours of the particular part. Such punches may include geometric figures as well as punches having curved faces which enable the production of rounded pieces. Such tooling may also be used to produce internal part features such as holes or slots. This avoids the need for subsequent operations to produce these features. As a result, parts may be manufactured more quickly, at higher quality and at a lower cost.

A significant drawback associated with producing parts using high speed programmable multi-punch machines is that the parts often have burrs produced by metal from the tab that remains with the part after it is removed from the work piece. These burrs are generally sharp. If the parts produced are going to be located in an area where they will come in contact with a person's fingers or skin, the burrs must be removed to prevent cuts and scrapes. It is also common for parts to be in sliding engagement with other parts. Burrs that result from residual tab material may hinder the parts ability to perform its intended function. As a result, it is often necessary to remove such burrs.

Unfortunately, the removal of such burrs from parts produced on programmable multi-punch machines is somewhat difficult. This is because the burrs reside along the relatively thin side wall of the part. It is difficult to remove such burrs using automatic equipment because it is difficult to handle the parts in this orientation. Often it is necessary for an individual to manually flatten or remove the burrs using a file, grinding wheel, or belt sander. Such operations are time consuming and expensive. Further, because such operations are not automated and are generally performed by individuals not having a high degree of skill, the quality of the burr removal operation is often not as great as is desired.

An alternate method for similar fabrication of parts on a programmable multi-punch machine is to punch the complete contour without the use of the holding tabs. With this method, the part is separated from the external portion of the sheet when the last material is punched. Based on the size of the part, the machine is then programmed to either stop or to eject the part down a chute into a receiving bin. When the machine stops (for large parts), the operator has to manually remove the completed part and restart the machine. When the parts are ejected down a chute (for small parts), the machine continues to run, but the punching cycle is delayed while the chute opens and closes. Both of the alternatives create undesirable production delays. The chute method adds another potential problem of part distortion depending on how the parts fall and land on one another in the receiving bin. Therefore, neither method is acceptable for long term quality production.

Thus, there exists a need for a device and method that may be used to produce generally burr-free parts on a programmable punch machine.

DISCLOSURE OF INVENTION

It is the object of the present invention to provide a tabbing tool that can be used to reduce residual tab burrs on parts produced in a programmable punch machine.

It is a further object of the present invention to provide a tabbing tool that deforms the tabs holding parts being punched in a work piece on a programmable punch machine so as to enable such parts to be held during punching, and readily removed from the work piece thereafter.

It is a further object of the present invention to provide a tabbing tool that reliably produces a fracture zone at a desired location for parts being produced on a programmable punch machine.

It is a further object of the present invention to provide a tabbing tool that deforms a tab holding a part being punched on a programmable punch machine so that any residual material remaining after the part is separated from the work piece extends in a direction transverse to the major faces of the part and can be readily removed through automatic deburring operations.

It is a further object of the present invention to provide a method for producing parts from a generally planar stock work piece using a programmable punch machine, which parts have fewer residual tab burrs.

It is a further object of the present invention to provide a method for producing parts from a work piece using a programmable punch machine in which the parts are securely held in the work piece during punching and may be readily removed from the work piece by shaking after completion of the punching operations.

It is a further object of the present invention to provide a method for producing parts on a programmable punch machine which includes deforming a tab with a tabbing tool so as to reduce burring.

It is a further object of the present invention to provide a method for producing parts on a programmable punch machine wherein slight misalignment of the work piece and the punching ram of the machine can be tolerated without producing parts having excessive burring.

Further objects of the present invention will be made apparent in the following Best Modes for Carrying Out Invention and the appended Claims.

The foregoing objects are accomplished in a preferred embodiment of the invention by a tabbing tool which is used in conjunction with a programmable punch machine. The programmable punch machine operates in a conventional manner to punch openings of desired shapes in a generally planar piece of stock such as sheet metal. The openings are punched through the use of multiple punch and die sets. The punch portions of the sets are acted upon by a ram of the machine. The ram moves at a high speed in coordination with the work piece under the programmable control of a processor to punch openings at desired locations in the work piece. The openings define a portion of the work piece that will eventually become a part and separate the parts from the external portions of the work piece that will constitute residual material at the completion of the operations.

The punching of openings in the work piece is selectively controlled so that tabs extend between the parts portions and the external portions of the work piece. The tabs serve to hold the parts portions securely engaged with the external portions of the piece until the completion of the punching operations. In the preferred form of the invention, the tabs are deformed using a tabbing tool so as to thin each tab at a desired location. This desired location or fracture zone is positioned to provide the desired surface contour at the completion of the punching operations and after the part is separated from the sheet through a shaking operation.

The preferred form of the tabbing tool includes a punch portion and a die portion. The punch portion comprises in cross section a first side surface which extends generally vertically in the preferred embodiment and terminates at its lower end in a point. The point is defined by an intersection of the first side surface and a first punch face that extends transversely from the point at a generally shallow angle relative to a perpendicular direction. A second punch face joins the first punch face a short distance from the point. The second punch face is at a significantly greater angle.

The preferred embodiment of the tabbing tool also includes a die portion that extends in aligned relation underneath the work piece. The die portion includes a recess. The recess in cross section is bounded by a straight edge that extends along the top surface of the die.

A first die surface extends generally parallel to the top surface. A generally vertically extending second surface extends between the straight edge and the first die surface. The first die surface extends between the second surface and a third die surface. The third die surface extends angularly upward to the top surface of the die at a relatively shallow angle.

In operation, the tabbing tool is used to deform tab portions of the work piece so that the tab is flattened and thinned at locations where a part is to be separated from the work piece. The tab is also deformed into the recess. The contours of the tabbing tool are such that the tab will reliably break during parts shake out at the desired location and so that any remaining burr on the part is minimal. Further, any burr generally extends in a direction that is transverse to a relatively flat major surface of the part. This enables the burr to be removed by automated equipment that can readily remove burrs which extend transverse to the large major flat surfaces of the parts.

The preferred embodiment of the tabbing tool also compensates for slight misalignment of the work piece during the punching process. The tab tool is designed such that if the tab is not struck in precisely the desired location, the amount of the burr will still be minimized.

The tabbing tool and method of the present invention eliminates the need for extra deburring operations for removal of tab burrs on many parts and enables deburring to be done with automated equipment. As a result, the overall quality of the parts is improved and cost is reduced.

BEST MODES FOR CARRYING OUT INVENTION

Figure 1:
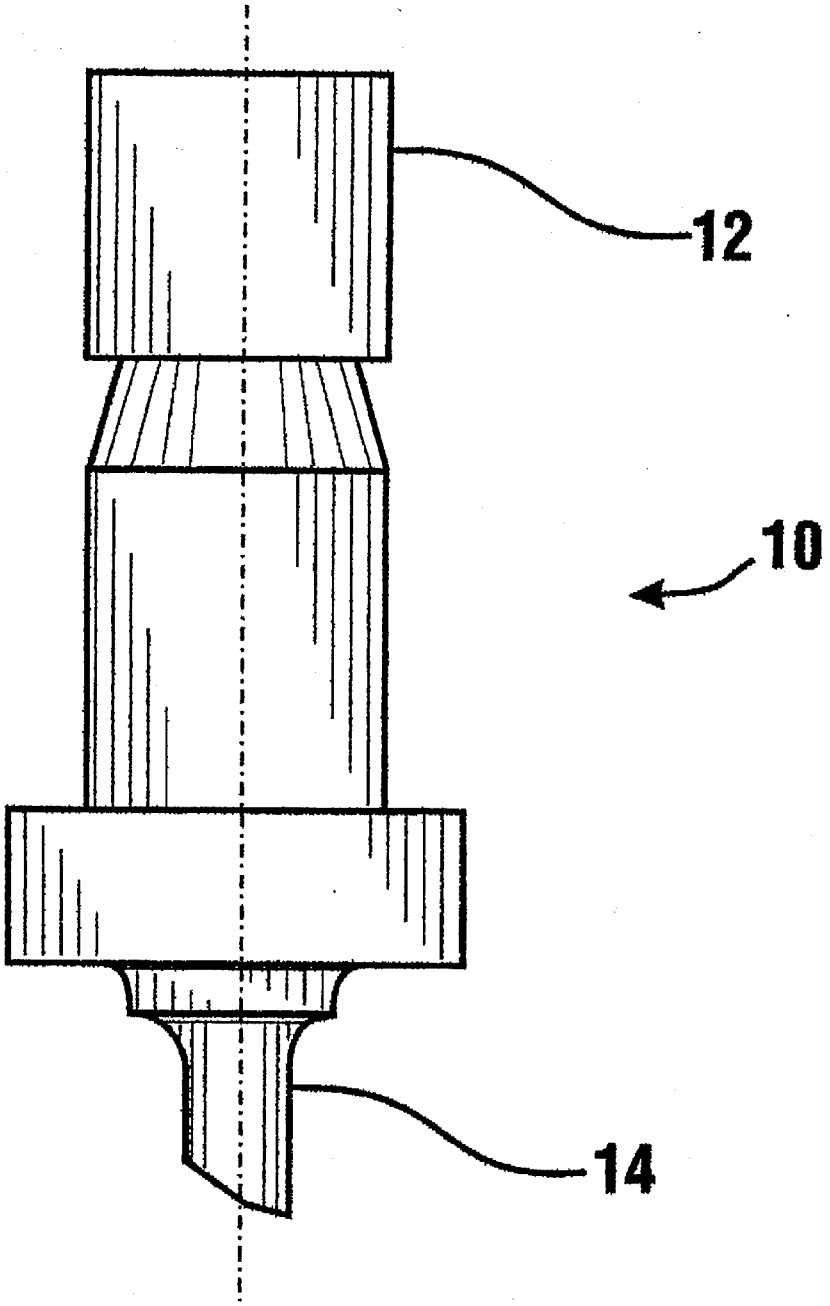
FIG. 1 is a side view of a punch portion of the tabbing tool of the preferred embodiment of the present invention.

Referring now to the drawings and particularly FIG. 1, there is shown therein a punch portion of the tabbing tool of the present invention generally indicated 10. The punch portion 10 has a shank 12 and a head 14. The shank is of the conventional type used for holding a punch portion connected to a punching ram of a programmable multi-punch machine.

Figure 2:
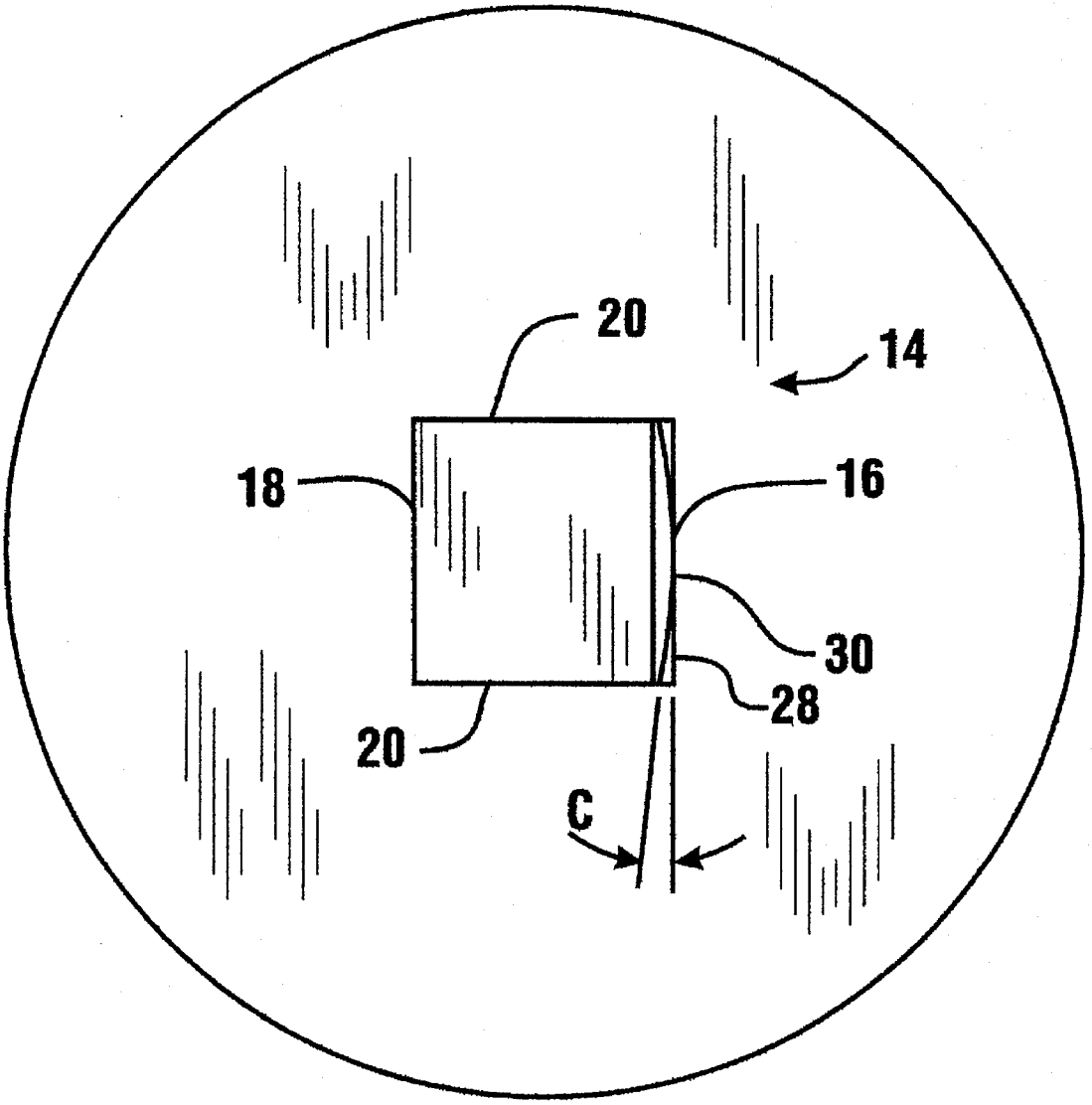
FIG. 2 is an enlarged end view of the punch portion of the tabbing tool shown in FIG. 1.

As best shown in FIG. 2, the head 14 of the punch portion is generally rectangular in cross section. The head has a first side surface 16 and an opposed side face 18. A pair of side walls 20 extend between the side faces. In the preferred embodiment of the invention the head is generally square. Of course, in other embodiments other geometric configurations may be used.

Figure 6:
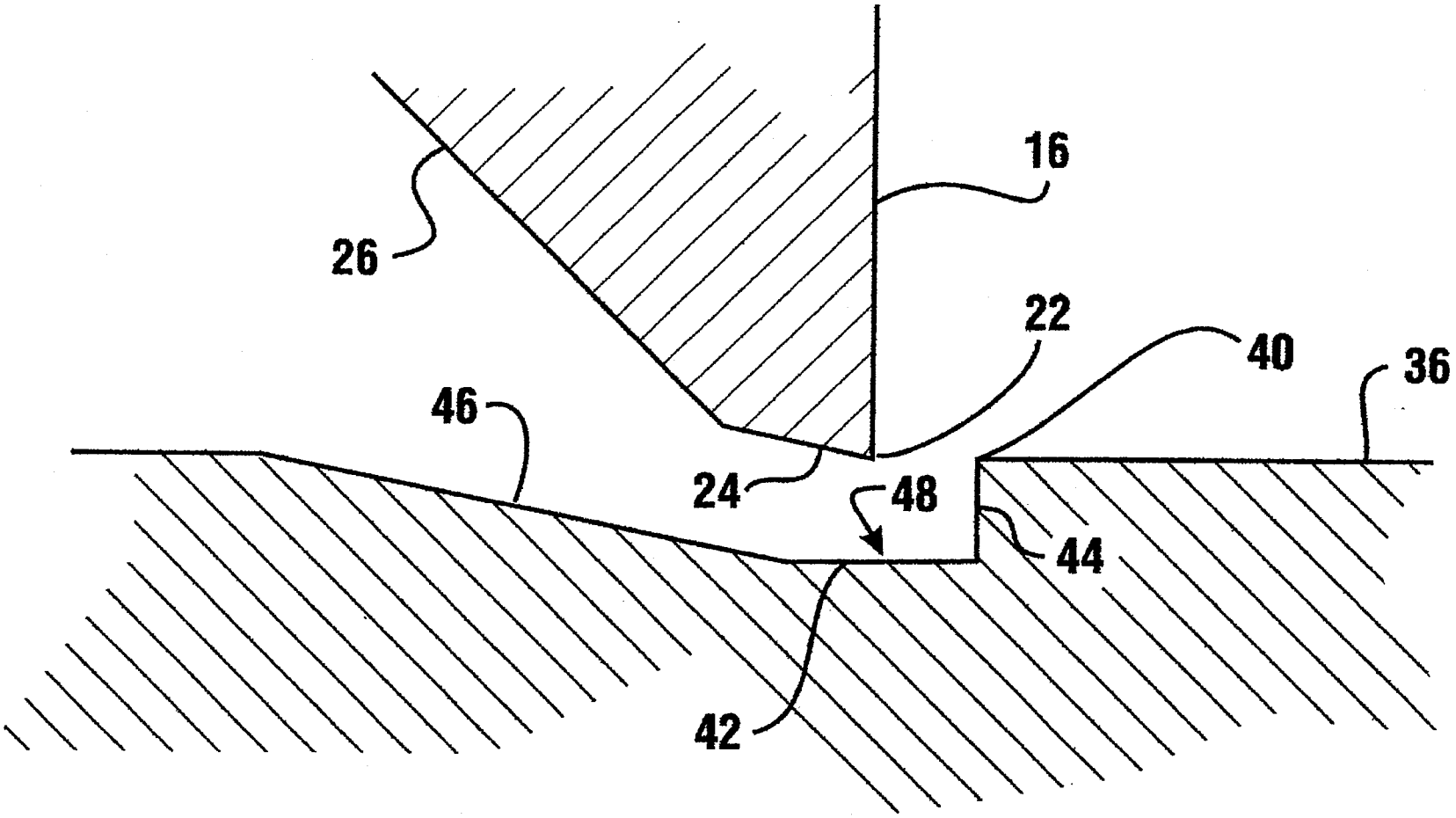
FIG. 6 is a greatly enlarged cross sectional view of the die and punch portions shown in position for deforming a web of a work piece.

The first side surface 16 which is best shown in FIG. 6, terminates at a point 22. Point 22 is formed at the intersection of first side surface 16 with a first punch face 24. First punch face 24 extends at a shallow angle relative to a perpendicular direction. In the preferred form of the invention the shallow angle is in a range from about three degrees to fifteen degrees. For steel materials, which is the primary use for the preferred embodiment for the tab tool of the present invention, an optimum angle for the first punch face 24 is generally about ten degrees.

First punch face 24 extends in the perpendicular direction a first distance. First punch face 24 extends to a second punch face 26. Second punch face 26 extends at a substantially greater angle than the shallow angle of first punch face 24. In the preferred embodiment of the present invention, the first punch face 24 extends in the perpendicular direction a first distance of from about 0.010 to 0.020 inches from the point 22 to where the first punch face meets the second punch face. In the version of the invention used with steels, the optimal distance has been found be to about 0.015 inches.

Second punch face 26 optimally extends at a much greater angle than the shallow angle of the first punch face. In the preferred form of the invention the face 26 extends at an angle of at least forty degrees relative to the perpendicular direction. It has been found that optimally for steels, the second angle of the second punch face is about forty-five degrees.

As shown in FIG. 2, first side surface 16 includes two symmetric tapered portions 28 adjacent the point. The tapered portions optimally extend at an angle indicated C, which is from about three degrees to nine degrees. In the embodiment of the present invention which is used in conjunction with punching steel, the tapered portions extend at about six degrees. The first side surface also includes a generally planar central portion 30 that extends between the tapered portions. In an embodiment of the invention for use with steel, the head 14 of the punch portion is generally about 0.250 inches square. In this embodiment the central portion 30 of the first side surface is from about 0.075 inches to about 0.085 inches, and is preferably about 0.080 inches.

Figure 3:
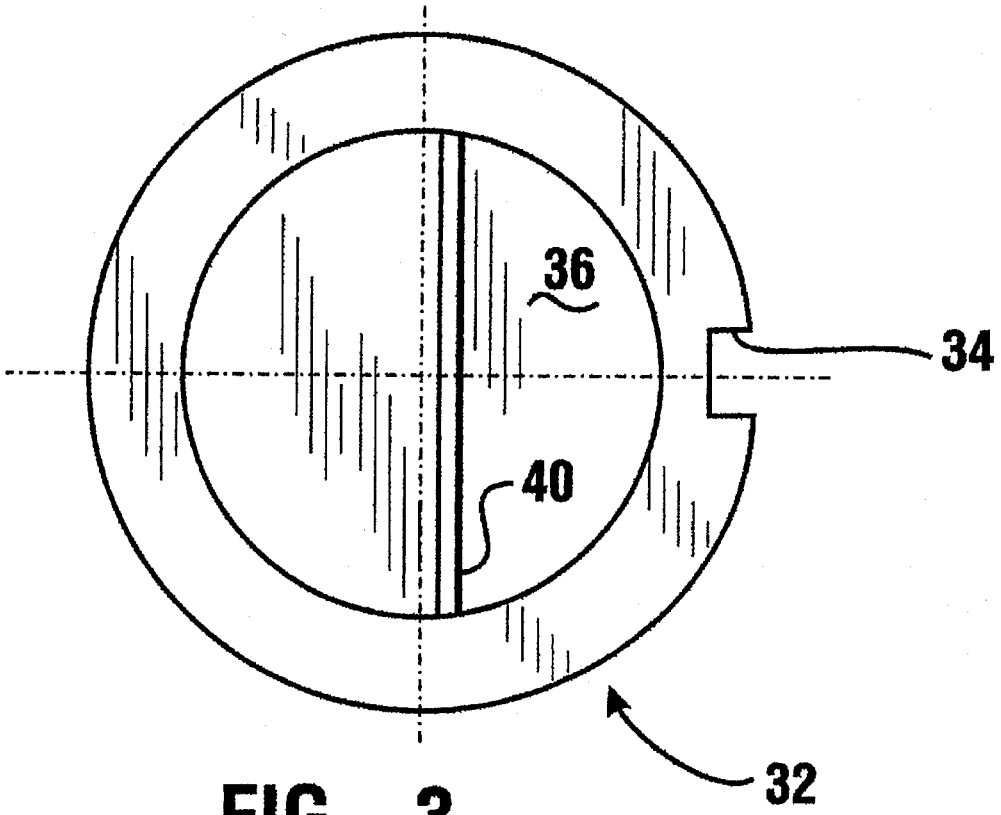
FIG. 3 is a top plan view of a die portion of the tabbing tool of the preferred embodiment of the present invention.
Figure 4:
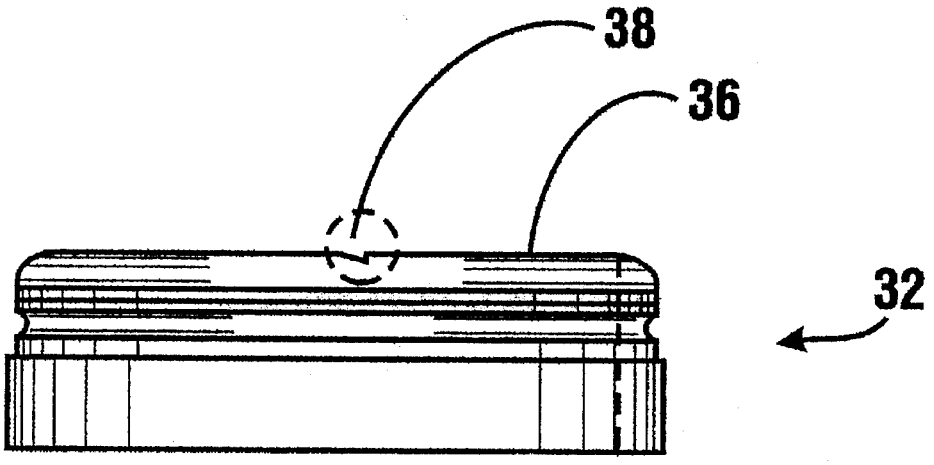
FIG. 4 is a side view of the die portion of the tabbing tool shown in FIG. 3.
Figure 5:
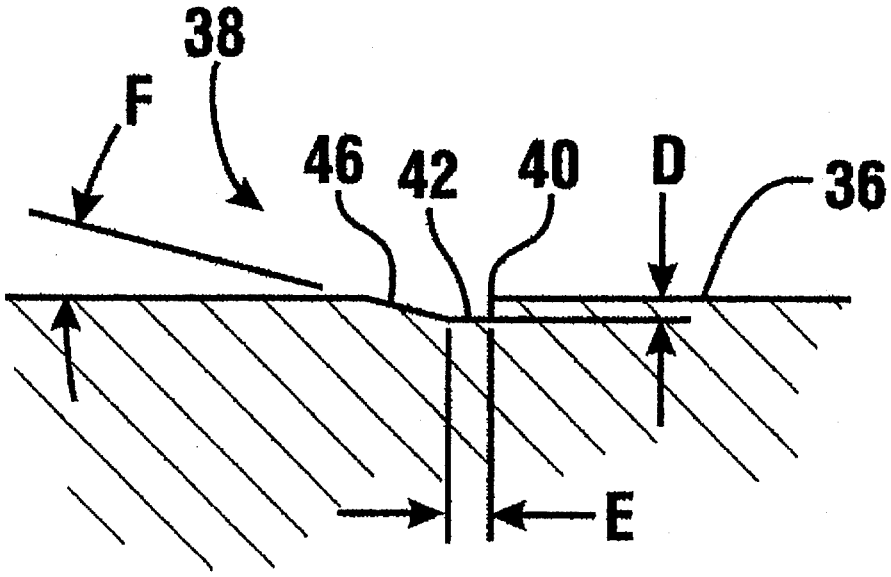
FIG. 5 is an enlarged cross sectional view of the portion of the die shown circled in FIG. 4.

The tabbing tool of the present invention also includes a die portion generally indicated 32 and shown in FIGS. 3 through 5. Die portion 32 is generally disk shaped in a conventional manner. During operation it is mounted in centered aligned relation with respect to the punch portion 10. Die portion 32 further includes a keyway 34 for holding the die portion in a holder in a punching machine in a conventional manner.

Die portion 32 further includes a generally planar top surface 36. Top surface 36 is a generally planar surface which extends generally perpendicular to the direction in which the punch portion moves relative to the die portion during operation of the punching machine. In the preferred form of the invention the punch and die portions are aligned in the vertical direction.

The die portion further includes a recess 38. Recess 38 is a relatively small recess compared to the size of the die and is shown enlarged in FIG. 5. Recess 38 is bounded by straight edge 40. Straight edge 40 extends across the top surface of the die. A first die surface 42 bounds the bottom portion of recess 38 and extends generally parallel to top surface 36. A second side surface 44, best shown in FIG. 6, extends in the first direction between straight edge 40 and first die surface 42. In the preferred form of the invention, first die surface 42 is recessed a distance D from the top surface 36 of the die. In the preferred form of the invention, distance D is from about 0.005 to 0.020 inches, and in the optimum version of the invention used with steels, is about 0.012 inches.

First die surface 42 extends in the perpendicular direction a distance E from the second die surface as shown in FIG. 5. In the preferred form of the invention distance E is about from 0.015 to 0.025 inches, and in the optimum version of the invention for use with steels is about 0.020 inches.

A third die surface 46 extends from second die surface to top surface 36. In the preferred form of the invention, third die surface 46 extends at an angle F as shown in FIG. 5. Angle F of the third die surface is a generally shallow angle comparable to the angle of first punch face 24 on the punch portion of the tabbing tool.

Figure 7:
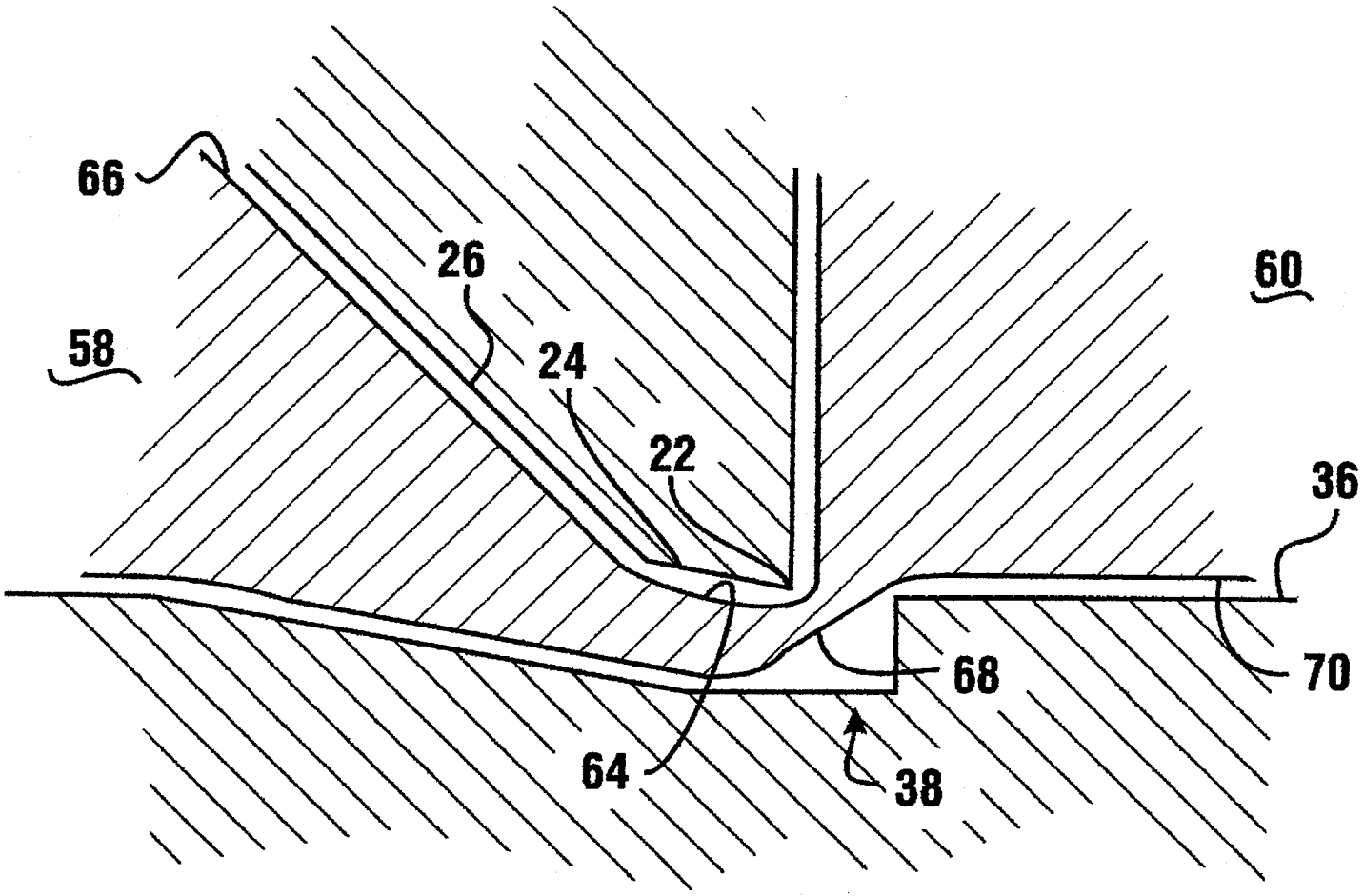
FIG. 7 is a cross sectional view of the die and punch portions shown in FIG. 6 along with a tab shown in deformed position.

As best shown in FIGS. 6 and 7, when mounted in their respective positions in a punching machine, the punch portion 10 and die portion 32 are oriented such that point 22 of the punch portion is slightly disposed from the straight edge 40 of the die portion. In the optimal version of the invention used with steels, the point is disposed in a perpendicular direction about 0.010 inches from the straight edge. Of course, in other embodiments where other materials and configurations are involved, the distance that the point is disposed from the straight edge may be tailored to the particular material.

When the punch portion moves towards the die portion in the punching machine, the point does not contact the die portions. Rather, the point remains disposed in the first direction from first die surface 42 at the bottom of the die portion, even at its point of closest approach, by a clearance distance. In the optimum embodiment of the invention used with steels, the point approaches to about the level of the top surface 36. Thus, when viewed in cross section point 22 is generally coplanar with top surface 36. Of course, in other embodiments and for other materials, other clearance distances may be used.

It should be understood that in this preferred embodiment the clearance distance between the point 22 and surface 42 at the point of closest approach is the shortest distance between faces 24 and 26 of the punch portion and surfaces 42 and 46 of the die portion. Further the area defined by a projection of first side surface 16 and the point 22 of the punch onto the first die surface 42 in the direction of relative movement defines a break area generally indicated 48 wherein a tab will eventually be caused to fracture and separate from the parts in a manner hereinafter discussed.

Figure 8:
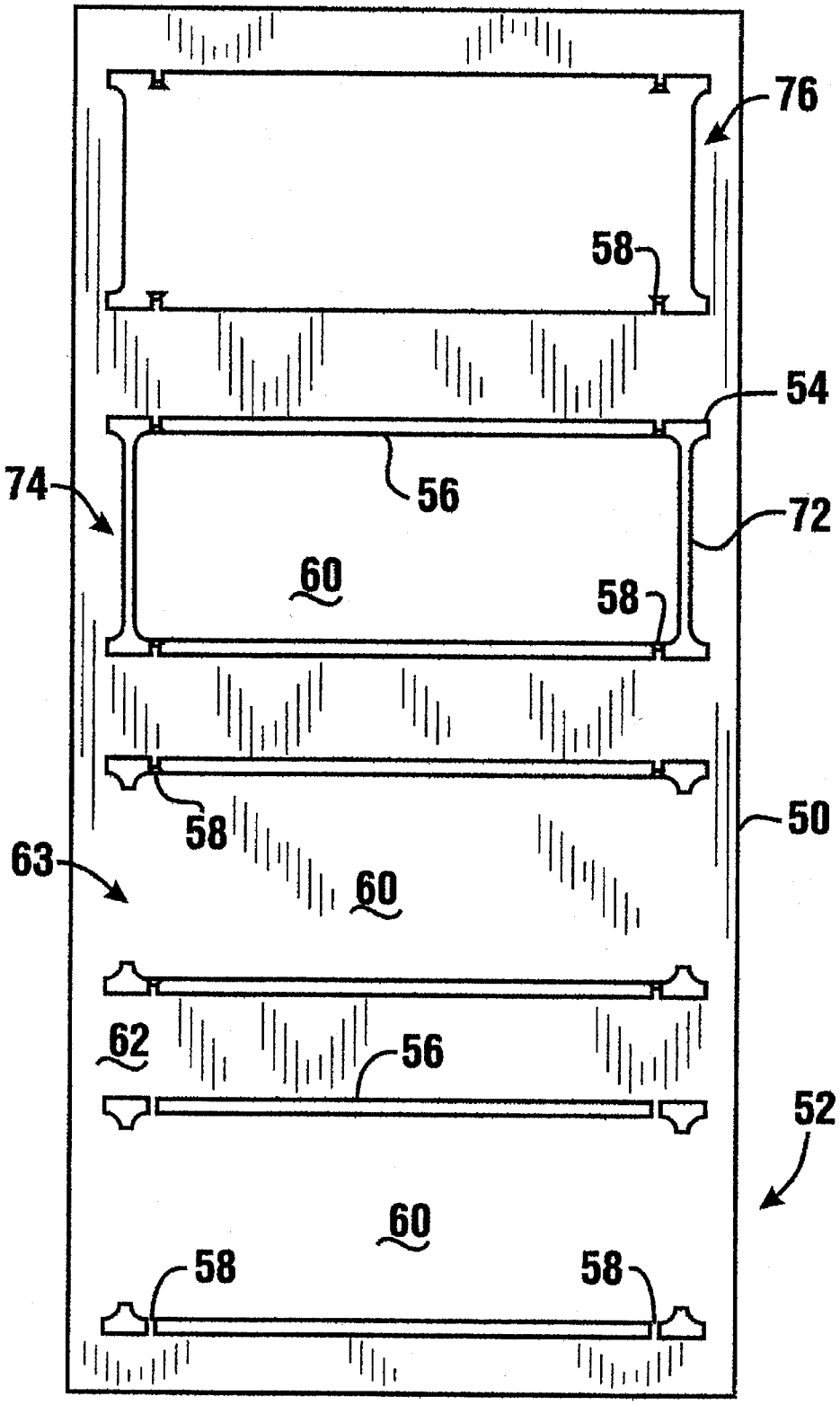
FIG. 8 is a top plan view of a work piece showing the progressive formation of a part made in accordance with the method and tabbing tool of the present invention.

An example of the operation of the tabbing tool and method of the present invention is demonstrated with regard to FIGS. 7 and 8. FIG. 8 shows a work piece 50 which is a generally planar sheet-like piece of metal. Work piece 50 may be of any desired thickness, however, the optimum embodiment of the invention is used with 11, 14, 16, 18, and 20 gauge sheet steel. It should also be understood that in the preferred embodiment of the invention, work piece 50 may be a very large sheet of steel that is sized for producing a large number of parts from a single piece.

In this example the punching process begins with the punching of openings in the sheet in the area indicated 52.

Of course, in other embodiments the operation may start by punching openings across the entire sheet. In this example the part to be produced is a simple rectangular piece with rounded corners. To produce this part four corner openings 54, are punched through the work piece. For each part, the corner openings are produced in the punching machine using an appropriately shaped punch and die set. Lateral openings 56 are then produced using a generally rectangular punch. The rectangular punch is much shorter than lateral openings 56. Openings 56 are produced by the punch making a number of holes through the sheet in a side by side relationship.

Extending between openings 54 and 56 are tabs 58. The tabs 58 serve to hold the portion of the sheet that will become the part generally indicated 60, in attached relation to an external portion of the sheet generally indicated 62, which falls outside the area that will become a part. The tabs 58 in the form shown in area 52 are continuous and are the original tradeformed thickness of the sheet. The tabs serve to hold the part portion 60 secured to the work piece as the punching operations are accomplished. This enables the work piece to be moved so as to accurately locate the parts portion during the punching operations.

After the openings 54 and 56 have been formed, as shown in area 52, the next step in the preferred embodiment of the method is shown in FIG. 8 with reference to a second area generally designated 63. In second area 63 the tabs 58 are shown deformed by the tabbing tool.

To produce the deformed tabs shown in area 63, the tabbing tool operates in the manner shown in FIG. 7. The tabbing tool is operated so that the punch portion moves adjacent to the die portion and deforms the tab adjacent to the parts portion 60. The tabbing tool deforms the bottom of the tab so it extends into the recess 38. The first punch face 24 deforms the tab such that it has a first angled face 64 which extends at a shallow angle comparable to that of face 24. Face 26 of the punch portion similarly deforms the tab so as to have a second angled face 66. The action of the punch on the tab also serves to flatten and thin the tab adjacent to the part portion 60 of the work piece. The tabbing tool operates so that the tab is flattened and thinned adjacent to the part portion, but does not lose its continuity which serves to hold the part portion to the external portion of the work piece.

The tabbing tool deforms the tab so that it has a thin fracture zone 68 which is formed adjacent to the point 22 of the punch portion. The fracture zone 68 is the thinnest area of the deformed tab. It is also an area of the tab that is deformed so as to be turned to extend into the recess. The tab is preferably deformed so as to extend about at least 0.001 inches into the recess. By deforming the tab in this manner, the area of the fracture zone is caused to extend in a direction transverse to the top surface 36 of the die portion and the major faces 70 of the work piece.

Once the tabs have been deformed in the manner shown in FIG. 7, further openings 72 are punched in the work piece. Openings 72 extend between the corner openings 54. Openings 72 are punched in the work piece using a rectangular punch and die set in a manner similar to openings 56. The step of punching the openings 72 is shown in a third area 74 of the work piece 50 in FIG. 8.

The punching of openings 72 define the outer surface or contour of the part. It should be noted that the tabs 58 as deformed by the tabbing tool, extend in a colinear manner between the openings on either side of the tab and are consistent therewith to further define the contour of the part produced.

Once the contour of the part has been fully defined by punching openings in the work piece 50 and deforming the tabs with the tabbing tool, the part portion 60 can be removed from the external portion 62 of the sheet. The removal of the part portion is accomplished by shaking the sheet. The shaking causes deformation and stress which causes the tab portions to break in the fracture zones. As a result, the part portion 60 falls out of the sheet leaving the external portion. This step is represented in FIG. 8 with regard to the fourth area 76.

The step of shaking the sheet causes the tabs 58 to break in the fracture zones. This occurs because the metal as been deformed to be at its thinnest in the fracture zone. In addition, the shallow angle of the punch and die ensure that the areas away from the fracture zone are thicker so that the tab is most likely to break at the desired location in close proximity to the part portion.

The fact that the fracture zone where the tab separates from the part is closely adjacent and colinear to the punched openings on either side of the tab, significantly reduces burring. In addition, the deformation of the tab is effective to turn any burrs and cause them to extend in generally the same direction as any burrs which are formed at the edges of the other openings created by the punching of the openings in the work piece. These burrs extend generally perpendicular to the lower face 70 of the work piece. As a result, any slight burrs that remain in the area of the tab can be removed through automated processes in the same manner as burrs which may exist around the periphery of the work piece. Such deburring may be done by automated equipment which greatly reduces cost.

The tabbing tool of the present invention also compensates for slight misalignments between the work piece and the tabbing tool. Such slight misalignments are compensated for by the tapered portions 28 on the first side surface 16 of the punch portion. These tapered portions enable the fracture zone across the tab to be effective to accomplish the desired results, even if it is slightly disposed into the parts portion 60 or away from the parts portion in the tab. The tapered portions minimize the distortion of the part portion so that significant burring does not occur even when the fracture zone is not perfectly colinear with the contour of the part portion on each side of the tab. This further facilitates the use of the tabbing tool in the method of the present invention.

It should be further reinforced that the function of the tabbing tool of the preferred embodiment is to deform the tab and to thin and flatten it at a desired fracture zone. This ensures that when the parts are removed from the work piece the tabs predictably break so that very little excess metal remains attached to the parts, and therefore no burrs are produced. In addition, the turning of any residual material from the tabs that stays with a part to extend in a direction transverse to the major face of the piece substantially reduces burring and ensures that any burrs that remain are readily removed through automated processes.

In the embodiment of the invention shown, the tabbing tool is used to deform the tabs before the entire contour of the part is defined. In other embodiments of the method it may be desirable to deform the tabs after the contour is fully defined, or in some other intermediate step. Of course, it may be desirable in the formation of some parts to deform the tab while significantly more metal remains to hold the parts portions. This helps to ensure that the part portion will be accurately positioned at the time of deformation of the tab by the tabbing tool. If the work piece is allowed to undergo further operations before the deformation of the tab, there is some risk that the part portion could become mislocated due to deformation of the tabs prior to the operation thereon by the tabbing tool. As a result, the part portion would not be in the optimum location when it is acted on by the tabbing tool, resulting in slightly greater burring than could otherwise be achieved.

The preferred embodiment of the invention discussed above is used in conjunction with the formation of parts from sheet steels. The invention may also be applied to other materials in which parts are produced in punching operations. Further, the optimum dimensions mentioned above have been found to give a long, useful life with the punch and die portions made of hard tool steel. Of course, in other applications, and for use with other materials, other materials for the tabbing tool may be used.

Thus, the new tabbing tool and method of the present invention achieve the above-stated objectives, eliminate difficulties encountered in the use of prior devices and systems, solve problems and attain the deskable results described herein.

In the foregoing description certain terms have been used for brevity, clarity, and understanding. However, no unnecessary limitations are to be implied therefrom because such terms are for descriptive purposes and are intended to be broadly construed. Moreover, the descriptions and illustrations given herein are by way of examples, and the invention is not limited to the details shown and described. Further, in the following claims, any features described as a means for performing a function shall be construed to encompass any means capable of performing the stated function and shall not be deemed to be limited to the particular means for performing that function described in the foregoing description, or mere equivalents thereof.

Having described the features, discoveries, and principles of the invention, the manner in which it is constructed and operated, and the advantages and useful results attained; the new and useful structures, devices, elements, arrangements, parts, combinations, systems, equipment, operations, and relationships, are set forth in the appended claims.

We claim:

1. A tabbing tool for deforming a metal tab holding a part in connection with a generally flat stock work piece while said part is being produced therefrom, comprising:

a punch portion and a die portion;

said punch portion including in cross section;

a front side face extending in a first direction, wherein relative movement of said punch portion with respect to said die portion during operation is generally along said first direction;

a first angled punch face, said first angled face extending from said first side face at a shallow angle relative to a direction perpendicular to said first direction, whereby a point is formed at an intersection of said first side face and said first angled face;

a second angled punch face, said second angled face extending from said first angled face and at a second angle relative to said perpendicular direction, wherein said second angle is greater than said shallow angle; and, said die portion including in cross section;

a recess, wherein said recess enables acceptance of said tab therein when said punch and die portions are adjacent and deform said tab, and wherein said recess is bounded by at least one first die surface, wherein said first die surface includes at least one break area, and wherein said break area is disposed adjacent to an intersection of said first die surface and a projection from said point in said first direction, and wherein said first die surface in said break area is separated from said point in said first direction by a clearance distance when said tab is deformably accepted in said recess, and wherein said clearance distance is sufficient to maintain the continuity of said tab, and wherein said first die surface is disposed from said punch a distance greater than said clearance distance in all portions of first die surface away from said break area when said tab is deformably accepted in said recess.

2. The tabbing tool according to claim 1 wherein said first die surface of said die portion in cross section extends in generally the perpendicular direction, and further comprising a second die surface bounding said recess, wherein in cross section said second die surface extends in generally said first direction and is disposed from said point in said perpendicular direction.

3. The tabbing tool according to claim 1 wherein said first die surface of said die portion in cross section extends in generally the perpendicular direction, and wherein said die portion further comprises in cross section a third die surface bounding said recess, said third die surface disposed in the perpendicular direction from said break area and adjacent the second face of the punch portion, and wherein said third die surface extends at generally said shallow angle relative to said perpendicular direction.

4. The tabbing tool according to claim 2 wherein said die portion further comprises in cross section a third die surface bounding said recess, wherein said third die surface is disposed in the perpendicular direction from said break area and is adjacent the second face of said punch portion when said punch portion is adjacent said recess, and wherein said third die surface extends at generally said shallow angle relative to said perpendicular direction.

5. The tabbing tool according to claim 1 wherein said die portion further comprises a generally planar top surface, and wherein in cross section said top surface extends in said perpendicular direction and wherein said recess extends through said top surface in the first direction.

6. The tabbing tool according to claim 1 wherein said first angled face of said punch portion extends in cross section a first distance in said perpendicular direction, and wherein said first surface of said die portion extends in cross section a second distance in the perpendicular direction, and wherein said second distance is greater than said first distance.

7. The tabbing tool according to claim 2 wherein said second surface of said die portion is disposed from said break area a third distance in the perpendicular direction, and wherein said third distance is generally from 0.005 to 0.020 inches.

8. The tabbing tool according to claim 6 wherein said first distance is generally from 0.010 to 0.020 inches and said second distance is generally from 0.015 to 0.025 inches.

9. The tabbing tool according to claim 5 wherein said first surface is disposed from said top surface in the first direction by generally 0.005 to 0.020 inches.

10. The apparatus according to claim 1 wherein said shallow angle is from generally about three degrees to fifteen degrees.

11. The apparatus according to claim 1 wherein the second angle is generally greater than about forty degrees.

12. The tabbing tool according to claim 2 wherein said second surface is generally disposed from said break area in the perpendicular direction by generally about 0.010 inches.

13. The tabbing tool according to claim 6 wherein said first distance is generally about 0.015 inches and said second distance is generally about 0.020 inches.

14. The tabbing tool according to claim 6 wherein said recess comprises a second surface bounding said recess, and wherein said recess extends in generally the first direction, and wherein said second surface is disposed generally about 0.010 inches from said point of said punch portion in the perpendicular direction.

15. The tabbing tool according to claim 1 wherein said shallow angle is generally about ten degrees.

16. The tabbing tool according to claim 15 wherein said second angle is generally about forty-five degrees.

17. The tabbing tool according to claim 1 wherein said deformed tab extends in said recess in the first direction at least 0.001 inches.

18. The tabbing tool according to claim 1 wherein said punch portion is generally square in cross section.

19. The tabbing tool according to claim 1 wherein said first side surface adjacent said point comprises in a transverse cross sectional direction, a pair of tapered portions.

20. The tabbing tool according to claim 5 wherein said recess is bounded by a straight edge on said top surface of said die portion, and wherein said straight edge is adjacent said first side surface of said punch portion when said punch and die portions are adjacent.

21. The tabbing tool according to claim 20 wherein said first side surface in transverse cross section adjacent said point comprises a pair of tapered portions, and wherein said tapered portions are tapered away from said straight edge.

22. The tabbing tool according to claim 20 wherein said punch portion in transverse cross section comprises an opposed side surface opposed of said first side surface and a pair of spaced side walls extending generally perpendicular to said first side surface, and wherein said first side surface adjacent said point comprises a pair of tapered portions, and wherein said tapered portions extend further away from said straight edge in the perpendicular direction with increasing proximity to said side walls.

23. The tabbing tool according to claim 22 wherein said tapered portions in transverse cross section extend generally about three degrees to nine degrees relative to said straight edge.

24. The tabbing tool according to claim 23 wherein said first side surface comprises in transverse cross section adjacent said point, a generally planar central portion extending between said tapered portions.

25. The tabbing tool according to claim 24 wherein said side walls are generally spaced about 0.250 inches apart and wherein said central portion is generally about 0.075 inches to 0.085 inches and wherein said tapered portions extend at angles generally from about three degrees to nine degrees relative to said central portion.

26. A tabbing tool for deforming a metal tab holding a part being punched from a piece of generally flat stock, wherein said part is held in said piece during punching and is removed from said piece thereafter, comprising:

a punch portion and a die portion;

said punch portion comprising in transverse cross section a generally rectangular body having a first side face and an opposed side face, said punch portion further comprising a first punch face extending transversely of said first side face, said first punch face extending at a relatively shallow angle relative to a perpendicular direction, wherein said perpendicular direction extends in a direction generally perpendicular to the first side face, whereby a point is formed at the intersection of first side face and said first punch face, said first punch portion further comprising in cross section a second punch face extending from said first punch face to said opposed side face, said second punch face extending at a second angle, wherein said second angle is greater than said shallow angle relative to said perpendicular direction, said die portion comprising a generally planar top portion and a recess extending into said die portion from said top portion, said recess bounded in transverse cross section by an edge at an intersection of said recess and said top portion, and wherein said edge is disposed in said perpendicular direction from said point, and wherein when said punch portion and die portion are brought adjacent wherein said point extends in generally coplanar relation with said top portion with said tab positioned in between, said tab is deformed between said punch and die portions to extend in said recess without breaking the continuity of said tab across said recess.

27. The tabbing tool according to claim 26 wherein said recess comprises in cross section a first die surface bounding said recess, said first die surface extending generally in said perpendicular direction relative to said point and disposed in said die portion from said top surface, and wherein said point of said punch portion moves adjacent to said first die surface during operation of said tabbing tool to within a clearance distance, and wherein said recess is configured such that said clearance distance is a minimum distance between said punch portion and said first die surface when said point is in said coplanar relation with top portion.

28. The tabbing tool according to claim 27 wherein said recess of said first die portion further comprises in cross section a second die surface extending generally perpendicular to said top surface, said second surface die extending from said edge to said first surface.

29. The tabbing tool according to claim 28 wherein said recess of said die portion further comprises in cross section a third surface extending at generally said shallow angle from said first surface to said top surface.

30. A tabbing tool for deforming a metal tab holding a part being punched from a piece of generally flat stock, wherein said part is held in said piece during punching and is removed from said piece thereafter, comprising:

a punch portion and a die portion;

said punch portion comprising in transverse cross section a generally rectangular body having a first side face and an opposed side face, said punch portion further comprising a first punch face extending transversely of said first side face, said first punch face extending at a relatively shallow angle relative to a perpendicular direction, wherein said perpendicular direction extends in a direction generally perpendicular to the first side face, whereby a point is formed at the intersection of first side face and said first punch face, said punch portion further comprising in cross section a second punch face extending from said first punch face to said opposed side face, said second punch face extending at a second angle, wherein said second angle is greater than said shallow angle, said punch portion further comprising in cross section a pair of spaced side walls extending between and generally perpendicular to said first side face and said opposed side face, and wherein said first side face further comprises a pair of symmetric tapered portions adjacent said point, wherein said tapered portions are tapered toward said opposed side face with increasing proximity to said side walls;

said die portion comprising a generally planar top portion and a recess extending into said die portion from said top portion, said recess bounded in transverse cross section by an edge adjacent an intersection of said recess and said top portion, and wherein said edge is disposed in said perpendicular direction from said point, and wherein when said punch portion and die portion are brought adjacent with said tab positioned in between, said tab is deformed between said punch and die portions to extend in said recess.

31. A tabbing tool for deforming a metal tab holding a part in connection with a generally flat stock work piece while said part is being produced from said work piece, comprising:

a punch portion and a die portion;

said punch portion including in cross section:

a first side face extending in a first direction, wherein relative movement of said punch portion with respect to said die portion during operation is generally along said first direction;

a first angled punch face, said first angled face extending from said first side face at a shallow angle relative to a direction perpendicular to said first direction, whereby a point is formed at an intersection of said first side face and said first angled face;

a second angled punch face, said second angled face extending from said first angled face and at a second angle relative to said perpendicular direction, wherein said second angle is greater than said shallow angle; and, said die portion including in cross section:

a recess, wherein said recess enables acceptance of said tab therein when said punch and die portions are adjacent and deform said tab, and wherein said recess is bounded by at least one first die surface, wherein said first die surface includes a break area thereon, wherein said break area is adjacent an intersection of said first die surface and a projection from said point in said first direction, and wherein when said punch and die portions are brought adjacent to a point of closest approach so as to deform said tab into said recess while maintaining continuity of said tab across said recess, said point is disposed from said first die surface in said first direction and is separated from said first die surface by a clearance distance, wherein said clearance distance corresponds to a smallest distance between said first die surface and said punch portion at said point of closest approach.

32. A tabbing tool for deforming a metal tab holding a part in connection with a generally flat stock work piece while said part is being produced from said work piece, comprising:

a punch portion and a die portion;

said punch portion including in cross section:

a first side face extending in a first direction wherein relative movement of said punch portion with respect to said die portion during operation is generally along said first direction;

a punch face extending transversely relative to said side face, wherein said punch face intersects said side face to form a point and wherein said punch face extends from said point at a relatively shallow angle relative to a direction perpendicular to said side face;

said die portion including in cross section:

a generally planar top surface;

a recess extending in said die portion from said top surface, said recess bounded by a first die surface, wherein when said punch and die portions are brought into an adjacent relation wherein said tab is deformed to extend in said recess without breaking said tab, said point is disposed in said first direction from said first die surface and is separated therefrom by a clearance distance, and wherein with said punch and die portions in the adjacent relation, the clearance distance corresponds to a smallest distance between said first die surface and said punch portion at all points on said first die surface.

33. A tabbing tool for deforming a metal tab holding a part being punched from a piece of generally flat stock, wherein said part is held in said piece during punching, comprising:

a punch portion and a die portion;

said punch portion comprising in cross section:

a first side face extending in a first direction, wherein relative movement of said punch portion with respect to said die portion during operation is generally along said first direction;

a punch face extending transversely relative to said side face, wherein said punch face intersects with said side face to form a point, and wherein said punch face extends from said point at a relatively shallow angle relative to a direction perpendicular to said side face, and wherein said point comprises a closest point on said punch face to said die portion;

said die portion including in cross section:

a generally planar top surface, a recess extending in said die portion from said top surface, said recess bounded by a first die surface, wherein said first die surface intersects said top surface at an edge, and wherein said point is disposed from said edge in said perpendicular direction, and wherein when said punch portion and said die portion are brought into an adjacent relation wherein said point is generally coplanar with said top surface, a clearance distance separates said point and said first die surface in said first direction and said metal tab is produced within said clearance distance when said punch portion and said die portion are in said adjacent relation.

34. A method for producing a part from a generally planar metal work piece using the tabbing tool according to claim 1, comprising the steps of:

selectively removing stock from said piece by punching openings therein with at least one punch, wherein at least one tab is defined by said openings, and deforming said tab with the tabbing tool as defined in claim 1, wherein said tab is deformed into said recess of said die portion while continuity of tab is maintained.

35. A method for producing a part from a generally planar metal work piece using the tabbing tool according to claim 31, comprising the steps of:

selectively removing stock from said piece by punching openings therein with at least one punch, wherein at least one tab is defined by said openings, and deforming said tab with the tabbing tool as defined in claim 38, wherein said tab is deformed into said recess of said die portion while continuity of tab is maintained.

36. A method for producing a part from a generally planar metal work piece using the tabbing tool according to claim 33, comprising the steps of:

selectively removing stock from said piece by punching openings therein with at least one punch, wherein at least one tab is defined by said openings, and deforming said tab with the tabbing tool as defined in claim 33, wherein said tab is deformed into said recess of said die portion while continuity of tab is maintained.

* * * * *

UNITED STATES PATENT AND TRADEMARK OFFICE

CERTIFICATE OF CORRECTION

PATENT NO. : 5,655,401
DATED : August 12, 1997
INVENTOR(S) : Theodore L. Bauer, et. al.

It is certified that error appears in the above-indentified patent and that said Letters Patent is hereby corrected as shown below:

Column 14, line 65, "claim 38" is changed to --claim 31--.

Signed and Sealed this

Twenty-first Day of October 1997

Bruce Lehman

*Attest:*

BRUCE LEHMAN

*Attesting Officer*

*Commissioner of Patents and Trademarks*